US010078981B2

(12) United States Patent
Chung et al.

(10) Patent No.: US 10,078,981 B2
(45) Date of Patent: Sep. 18, 2018

(54) ORGANIC LIGHT EMITTING DISPLAY AND METHOD FOR DRIVING THE SAME

(71) Applicant: SAMSUNG DISPLAY CO., LTD., Yongin, Gyeonggi-Do (KR)

(72) Inventors: Gun-Hee Chung, Yongin (KR); Chang-Kyu Seol, Yongin (KR); Jun-Jin Kong, Yongin (KR); Jong-Woong Park, Yongin (KR); Hong-Rak Son, Yongin (KR); Hyun-Seuk Yoo, Yongin (KR); Joo-Hyung Lee, Yongin (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 661 days.

(21) Appl. No.: 14/613,426

(22) Filed: Feb. 4, 2015

(65) Prior Publication Data

US 2015/0243216 A1 Aug. 27, 2015

(30) Foreign Application Priority Data

Feb. 26, 2014 (KR) ..... 10-2014-0022510

(51) Int. Cl.
*G09G 5/00* (2006.01)
*G09G 3/3233* (2016.01)

(52) U.S. Cl.
CPC ..... *G09G 3/3233* (2013.01); *G09G 2320/048* (2013.01)

(58) Field of Classification Search
CPC ..... G09G 3/3233; G09G 2320/04; G09G 2320/043; G09G 2320/045; G09G 2320/046; G09G 2320/048; G09G 2320/06; G09G 2320/062; G09G 2320/0626; G09G 2320/0693
USPC ..... 345/214
See application file for complete search history.

(56) References Cited

U.S. PATENT DOCUMENTS

2006/0279490 A1 12/2006 Park et al.
2010/0225634 A1* 9/2010 Levey ..... G09G 3/3208 345/212
2012/0154460 A1 6/2012 Segawa et al.
2013/0002960 A1 1/2013 Ryu et al.
2013/0021389 A1 1/2013 Odawara et al.
(Continued)

FOREIGN PATENT DOCUMENTS

KP 10-2006-0128464 A 12/2006
KR 10-2012-0023615 A 3/2012
(Continued)

OTHER PUBLICATIONS

"The Role of Homolytic Reactions in the Intrinsic Degradation of OLEDs", Organic Electronics: Materials, Processing, Devices and Applications, copyright 2010 by Taylor and Francis Group, LLC; pp. 211-242.*

*Primary Examiner* — Mark Edwards
(74) *Attorney, Agent, or Firm* — Lee & Morse, P.C.

(57) ABSTRACT

A controller for a display device includes an adjuster and a compensator. The adjuster adjusts at least one parameter of a modeling equation based on a measured current of a pixel. The modeling equation including the at least one adjusted parameter is indicative of a real time degree of degradation of the pixel. The compensator compensates for image data corresponding to emission of light from the pixel.

15 Claims, 4 Drawing Sheets

(56) References Cited

U.S. PATENT DOCUMENTS

2014/0168191 A1* 6/2014 Byeon ..... G09G 3/3233
345/212

FOREIGN PATENT DOCUMENTS

KR 10-2013-0002118 A 1/2013
KR 10-2013-0043039 A 4/2013

* cited by examiner

ORGANIC LIGHT EMITTING DISPLAY AND METHOD FOR DRIVING THE SAME

CROSS-REFERENCE TO RELATED APPLICATION

Korean Patent Application No. 10-2014-0022510, filed on Feb. 26, 2014, and entitled, "Organic Light Emitting Display and Method For Driving the Same," is incorporated by reference herein in its entirety.

BACKGROUND

1. Field

One or more embodiments described herein relate to a display device and method for driving the same.

2. Description of the Related Art

A variety of flat panel displays have been developed. Examples include liquid crystal displays, field emission displays, plasma display panels, and organic light emitting displays. Organic light emitting display generate images using organic light emitting diodes that emit light based on a recombination of electrons and holes. These displays have fast response speed and low power consumption.

SUMMARY

In accordance with one embodiment, an organic light emitting display includes a current measurement unit configured to measure current supplied to an organic light emitting diode in a pixel; a parameter adjustment unit configured to adjust a parameter of a lifetime modeling equation based on the measured current and an estimated current value corresponding to a pixel value of a current frame; an accumulation unit configured to generate an accumulation value by accumulating pixel values supplied to the pixel until a current frame; and a compensation unit configured to compensate a pixel value after the current frame based on the lifetime modeling equation and accumulation value. The lifetime modeling equation is based on the following equation:

$$PL = 1 + S \cdot \lambda^{\frac{1}{T}},$$

where PL is indicative of a current emission efficiency prior to degradation of the pixel, S is a first parameter of a predetermined function, T is a second parameter of the predetermined function, and λ is indicative of the accumulation value.

The parameter adjustment unit may store a current difference ratio of the measured current value and the estimated current value corresponding to each frame and the accumulation value during a plurality of frames, and may determine the parameter of the lifetime modeling equation based on a relationship between the current difference ratio and the accumulation value.

The parameter adjustment unit may calculate a primary function between a log value of the current difference ratio and a log value of the accumulation value, the primary function corresponding to the predetermined function, determine first parameter S based on an intercept of the primary function, and determine second parameter T based on a slope of the primary function.

The parameter adjustment unit may calculate the primary function using a least squares method. The first parameter S may be a negative number. The pixel may be in a display area. The pixel ma be in a non-display area.

In accordance with another embodiment, a method for driving an organic light emitting display includes measuring current supplied to an organic light emitting diode in a pixel; adjusting a parameter of a lifetime modeling equation based on the measured current value and an estimated current value corresponding to a pixel value of a current frame; and compensating the pixel value after the current frame based on the lifetime modeling equation and an accumulation value obtained by accumulating pixel values supplied to the pixel until a current frame, wherein the lifetime modeling equation is represented by the following equation:

$$PL = 1 + S \cdot \lambda^{\frac{1}{T}},$$

where PL is indicative of a current emission efficiency prior to degradation of the pixel, S is a first parameter of a predetermined function, T is a second parameter of the predetermined function, and λ is indicative of the accumulation value.

Adjusting the parameter of the lifetime modeling equation may include storing a current difference ratio of the measured current value and the estimated current value corresponding to each frame and the accumulation value during a plurality of frames; and determining the parameter of the lifetime modeling equation based on a relationship between the current difference ratio and the accumulation value.

Determining the parameter may include calculating a primary function between a log value of the current difference ratio and a log value of the accumulation value, the primary function corresponding to the predetermined function; and determining first parameter S based on an intercept of the primary function, and determining second parameter T based on a slope of the primary function. The primary function may be calculated using a least squares method. The first parameter S may be a negative number.

In accordance with another embodiment, a controller includes an adjuster to adjust at least one parameter of a modeling equation based on a measured current of a pixel, the modeling equation including the at least one adjusted parameter indicative of a real time degree of degradation of the pixel; and a compensator to compensate for image data corresponding to emission of light from the pixel based on the modeling equation including the at least one adjusted parameter.

The at least one parameter may be a parameter of a primary function between a log value of a current difference ratio and a log value of an accumulation value. The current difference ratio may be a ratio of the measured current and an estimated current value and the accumulation value, and the accumulation value may be based on accumulated pixel values supplied to the pixel over a plurality of frames. The parameter adjustment unit may calculate the primary function using a least squares method.

The at least one parameter may be based on an intercept of the primary function or a slope of the primary function. The estimated current value may be based on a pixel value in first image data.

The adjuster may adjust the at least one parameter of the modeling equation based on the measured current, first image data, and accumulation data, and the compensator may convert the first image data to second image data based on the adjusted parameter and the accumulation data. The accumulation data may be based on accumulating pixel values in the first image data.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
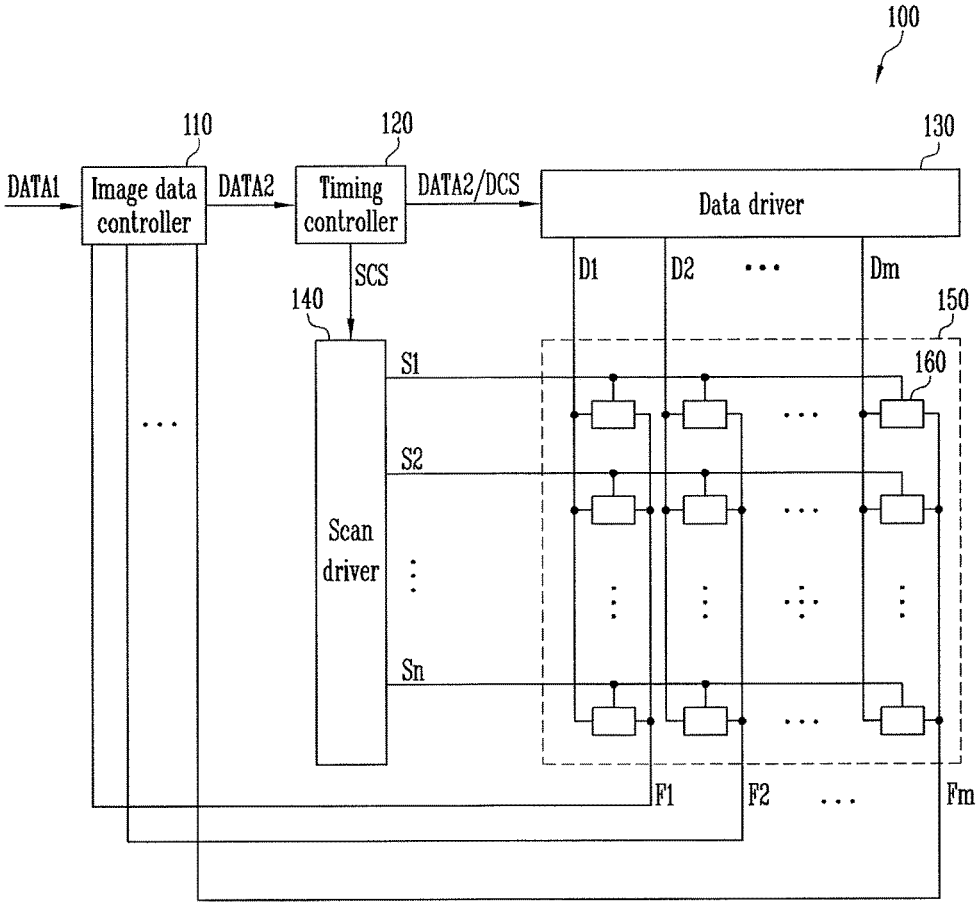
FIG. 1 illustrates an embodiment of an organic light emitting display.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

FIG. 1 illustrates an embodiment of an organic light emitting display 100 which includes an image data controller 110, a timing controller 120, a data driver 130, a scan driver 140, and a display unit 150. The image data controller 110 generates second image data DATA2 by compensating first image data DATA1 from an external source (e.g., an application processor of a host) based on degradation of pixels 160.

For example, the image data controller 110 measures current supplied to an organic light emitting diode (OLED) in the pixel 160, and adjusts one or more parameters in a modeling equation (or other algorithm) of the pixel 160 based on the measured current value. The modeling equation including the one or more adjusted parameters provides an indication of an actual (or real time) degree of degradation of the pixel, as opposed to a purely theoretical (or static) model which is not based on actual or real-time pixel degradation and which therefore may not allow for accurate compensation.

The modeling equation may be, for example, a lifetime modeling equation for the pixel 160. In alternative embodiments, the modeling equation may be based on another predetermined period of time (e.g., different from an estimated useful lifetime of a pixel) and/or may be based on one or more parameters that affect pixel operation, e.g., temperature, manufacturing variations, etc. For example, in the aforementioned alternative embodiments, the modeling equation may be different from the Equations 1 and 2 discussed below.

Subsequently, image data controller 110 converts first image data DATA1 to second image data DATA2 based on the modeling equation (or algorithm) having the adjusted parameters and an accumulation value obtained by accumulating pixel values supplied to pixel 160.

The emission efficiency of pixel 160 may gradually deteriorate over time. In accordance with one embodiment, the emission efficiency of the pixel 160 may be modeled using a life modeling equation that is based on Equation 1.

$$PL = 1 + S\left(\sum_i \left(t_i\left(\frac{d_i}{d_{max}}\right)^{\gamma \cdot Acc}\right)\right)^{\frac{1}{T}} \tag{1}$$

In Equation 1, PL is a current emission efficiency taken relative to the efficiency that existed before degradation of the pixel 160, S is a first parameter, T is a second parameter, Acc is a third parameter, $\gamma$ is a gamma constant, ti is an emission time of the pixel 160 in an i-th frame, dmax is a maximum pixel value, and di is a pixel value of the pixel 160 in the i-th frame. The first parameter S may be a negative number.

When the organic light emitting display 100 is operated by an analog driving method (e.g., a method of expressing gray scale values by supplying current to OLEDs with an amplitude corresponding to gray scale values of pixels) during a predetermined period in one frame, emission time ti is constant and pixel value di is variable.

The emission efficiency PL of the pixel 160 decreases in proportion to an accumulation value of emission time ti and/or an accumulation value of pixel value di until a current frame, i.e., an i-th frame. In accordance with one embodiment, a pixel value is indicative of a value that corresponds to the emission gray scale of pixel 160 during one frame.

In Equation 1, the gamma constant $\gamma$ and third parameter Acc are almost constant. When assumed to be constant, Equation 1 may be reduced to Equation 2.

$$PL = 1 - \psi = 1 + S \cdot \lambda^{\frac{1}{T}} \tag{2}$$

In Equation 2, $\psi$ is indicative of a degradation ratio of the pixel and $\lambda$ is indicative of an accumulation value of the pixel value supplied to the pixel 160 until the current frame.

The degradation ratio $\psi$ may be expressed by a current difference ratio between a measured current value and an estimated current value corresponding to the pixel value supplied to the pixel 160 in the current frame. For example, degradation ratio $\psi$ may be expressed by Equation 3.

$$\psi = \frac{\Delta i}{i} \tag{3}$$

In Equation 3, i is indicative of an estimated current value and $\Delta$i is indicative of a difference value between the estimated current value and the measured current value.

Equation 4 may be obtained by adjusting Equations 2 and 3 and taking a log at both sides of the adjusted equation.

$$\log\left(\frac{\Delta i}{i}\right) = \log(-S) + \frac{1}{T}\log(\lambda) \quad (4)$$

In Equation 4, log(Δi/i) and log(λ) may be related by a primary function having a slope of 1/T and an intercept of log(−S).

The image data controller 110 measures current supplied to the OLED of the pixel 160 for each of a plurality of frames, and calculates a difference value between the measured current value and estimated current value for the pixel value of each frame.

The image data controller 110 calculates the slope and intercept from the difference values between the measured current values and estimated current values for each of the plurality of frames, and determines parameters according to the calculated slope and intercept. For example, image data controller 110 may determine first parameter S according to the intercept of the primary function and may determine the second parameter T according to the slope of the primary function.

The plurality of frames may be consecutive frames. In an alternative embodiment, the plurality of frames may not be non-consecutive frames, for example, separated by one or more predetermined time intervals. Image data controller 110 may calculate the slope and intercept, for example, using a least squares method.

Referring again to FIG. 1, the timing controller 110 controls operations of the data driver 130 and the scan driver 140 in response to a synchronization signal supplied from an external source. For example, the timing controller 120 generates a data driving control signal DCS and supplies the data driving control signal DCS to the data driver 130. The timing controller 120 generates a scan driving control signal SCS and supplies the scan driving control signal SCS to the scan driver 140.

The timing controller 120 supplies second image data DATA2 received from the image data controller 110 to the data driver 130. Although it has been illustrated in FIG. 1 that the image data controller 110 and the timing controller 120 are separate from each other, the image data controller 110 and the timing controller 120 may be implemented in a same circuit in an alternative embodiment.

The data driver 130 realigns the second image data DATA2 from the timing controller 120 in response to the data driving control signal DCS output from the timing controller 120, and supplies the realigned second data DATA2 as data signals to data lines D1 to Dm.

The scan driver 140 sequentially supplies a scan signal to the scan lines Si to Sn, in response to the scan driving control signal SCS output from the timing controller 120.

The display unit 150 includes pixels 160 which are respectively disposed at intersection portions of the data lines D1 to Dm, the feedback lines F1 to Fm, and the scan lines S1 to Sn. In this embodiment, the data lines D1 to Dm and the feedback lines F1 to Fm are vertically arranged and the scan lines S1 to Sn are horizontally arranged.

Each pixel 160 emits light with a luminance based on a data signal supplied through a corresponding one of the data lines D1 to Dm, when a scan signal is supplied to a corresponding one of the scan lines S1 to Sn. In another embodiment, the pixels 160 and the image data controller 110 may be coupled through the data lines D1 to Dm, rather than the feedback lines F1 to Fm.

Figure 2:
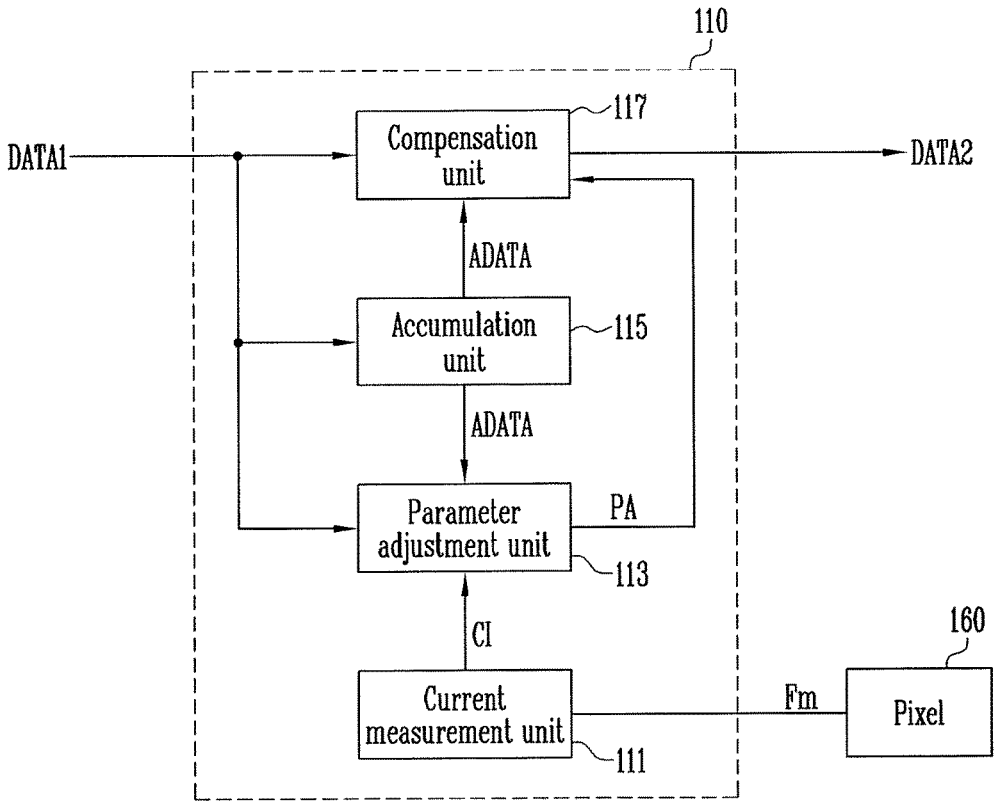
FIG. 2 illustrates an embodiment of an image data controller.
Figure 3:
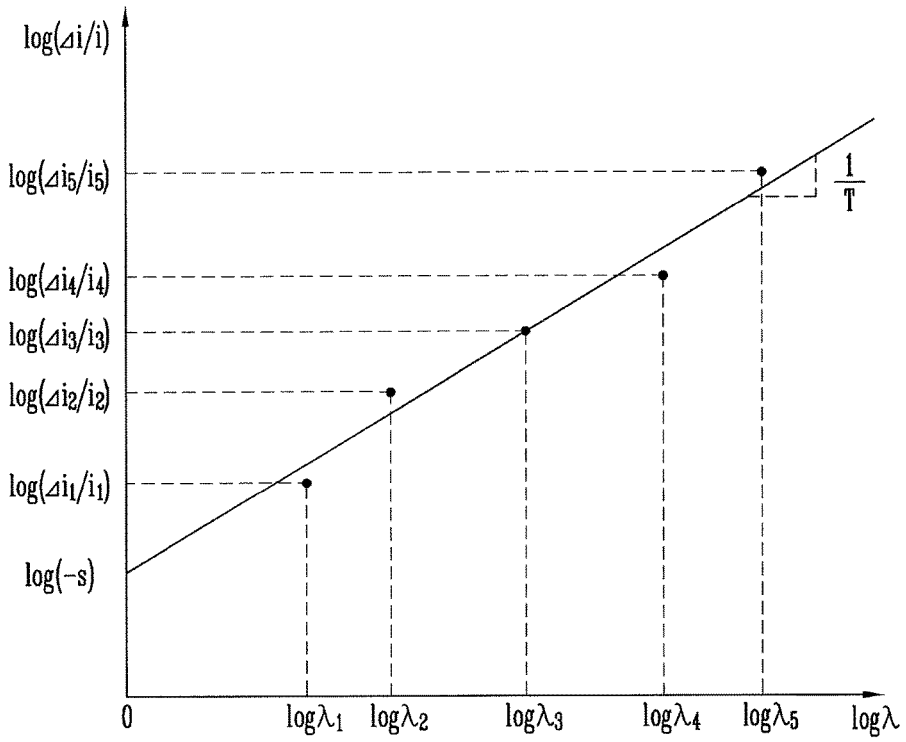
FIG. 3 illustrates a driving operation of an image data controller.

FIG. 2 illustrates an embodiment of an image data controller, and FIG. 3 is a graph illustrating an embodiment for driving the image data controller. In describing these embodiments, it will be assumed that a pixel 160 is coupled to image data controller 110 through a feedback line Fm. Moreover, it will be assumed that the pixel 160 is in a display area of a display panel in order to display an image. However, in another embodiment, the pixel 160 may be provided in a non-display area of the display panel, not for purposes of displaying an image but to calculate one or more parameters of the modeling equation previously discussed. For illustrative purposes, the modeling equation will be assumed to be the lifetime modeling equation for the pixel 160.

Referring to FIGS. 2 and 3, the image data controller 110 includes a current measurement unit 111, a parameter adjustment unit 113, an accumulation unit 115, and a compensation unit 117.

The current measurement unit 111 measures current supplied to an OLED in pixel 160. A signal or information indicative of the measured current (CI) is supplied to the parameter adjustment unit 113. The current measurement unit 111 may measure the current supplied to the OLED of the pixel 160, for example, based on signal (e.g., indicative of pixel current) received through the feedback line Fm.

The parameter adjustment unit 113 adjusts at least one parameter PA of the lifetime modeling equation, in response to first image data DATA, accumulation data ADATA, and current information CI. The adjusted parameter PA is supplied to the compensation unit 117. Here, parameter PA may include at least one of the first parameter S or second parameter T.

The parameter adjustment unit 113 calculates an estimated value of current to be supplied through the feedback line Fm from the pixel 160 (e.g., estimated current value i) based on the first image data. For example, the parameter adjustment unit 113 may calculate the estimated current value i based on the pixel value of the pixel 160 in the first image data.

The parameter adjustment unit 113 calculates difference value Δi between the calculated estimated current value i and the measured current value of the pixel 160, included in current information CI supplied from the current measurement unit 111. The parameter adjustment unit 113 also calculates and stores a ratio of the estimated current value i and calculated difference value Δi, e.g., current difference ratio Δi/i.

The parameter adjustment unit 113 calculates a primary function between log values of current difference ratios Δi/i calculated and stored for each of a plurality of frames and log values of accumulation values λ in each of the plurality of frames. This calculation may be performed using a least squares method. The parameter adjustment unit 113 may then determine parameters of the lifetime modeling equation based on the slope and intercept of the calculated primary function.

For example, as shown in FIG. 3, the parameter adjustment unit 113 calculates a primary function by applying the least squares method to log values of accumulation values λ1 to λ5 in each of first to fifth frames and log values of current difference ratios Δi1/i1 to Δi5/i5.

The accumulation unit 115 generates accumulation data ADATA by accumulating first image data DATA1, and supplies the accumulation data ADATA to the parameter adjustment unit 113 and the compensation unit 117. For example, the accumulation unit 115 generates an accumulation value by accumulating pixel values in first image data DATA1, and supplies accumulation data ADATA including the accumulation value to the parameter adjustment unit 113 and the compensation unit 117.

The compensation unit 117 converts the first image data DATA1 to second image data DATA2, in response to the accumulation data ADATA and parameter PA. The converted second image data DATA2 is supplied to the timing controller 120.

In one embodiment, the compensation unit 117 estimates a degradation ratio of the pixel by substituting, in the lifetime modeling equation of Equation 2, parameter PA supplied from the parameter adjustment unit 113 and the accumulation value included in accumulation data ADATA. The compensation unit 117 then generates second image data DATA2 by compensating the first image data DATA1, in order to compensate for degradation of the pixel 160.

Figure 4:
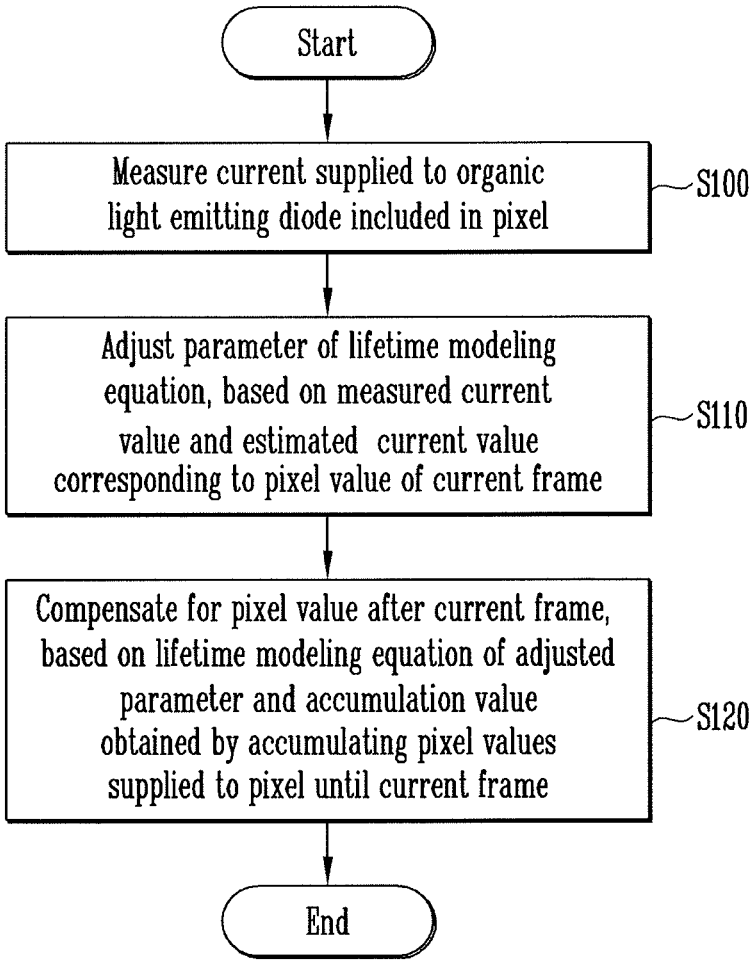
FIG. 4 illustrates an embodiment of a method for driving an organic light emitting display.

FIG. 4 illustrates an embodiment of a method for driving an organic light emitting display, which, for example, may be the display in FIG. 1. The method includes measuring current supplied to the OLED in a pixel (S100). A parameter PA of a modeling equation (e.g, lifetime modeling equation) is then adjusted based on the measured current value and an estimation current value corresponding to a pixel value of a current frame (S110).

For example, in operation S110, an estimated current value i corresponding to the pixel value of the current frame is calculated, and then a current difference ratio Δi/i of the estimated current value and measured current value is calculated and stored. A current difference ratio Δi/i calculated for each of the plurality of frames and an accumulation value in each of the plurality of frames is then stored, and a primary function between the log value of the current difference ratio Δi/i and the log value of the accumulation value is calculated based on the stored values. The parameter PA of the lifetime modeling equation is determined based on a slope and intercept of the calculated primary function.

Subsequently, image data is compensated based on the lifetime modeling equation having adjusted parameter PA and the accumulation value of the pixel (S120). For example, this operation may include compensating for the pixel value after the current frame based on a lifetime modeling equation for the adjusted parameter and accumulation value, obtained by accumulating pixel values supplied to the pixel until a current frame.

By way of summation and review, in an organic light emitting display, organic light emitting diodes and transistors in pixels degrade over time. Luminance differences between pixels may occur as a result of the degradation, and a luminance spot effect may occur from the luminance difference. These effects deteriorate image quality.

In accordance with one or more of the aforementioned embodiments, an organic light emitting display and method for driving the same are provided which compensates image data based on a lifetime modeling equation, which may take one or more variations into account including but not limited to process variations. Accordingly, pixel degradation may be more exactly compensated.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. An organic light emitting display, comprising:

a current measurer to measure current supplied to an organic light emitting diode in a pixel;

a parameter adjuster to adjust a parameter of a lifetime modeling equation based on the measured current and an estimated current value corresponding to a pixel value of a current frame;

an accumulator to generate an accumulation value by accumulating pixel values supplied to the pixel until a current frame; and a compensator to compensate a pixel value after the current frame based on the lifetime modeling equation and accumulation value, wherein the lifetime modeling equation is based on the following equation:

$$PL = 1 + S \cdot \lambda^{\frac{1}{T}},$$

where PL is indicative of a current emission efficiency prior to degradation of the pixel, S is a first parameter of a predetermined function, T is a second parameter of the predetermined function, and λ is indicative of the accumulation value, wherein the parameter adjuster is to store a current difference ratio of the measured current value and the estimated current value corresponding to each frame and the accumulation value during a plurality of frames, and determine the parameter of the lifetime modeling equation based on a relationship between the current difference ratio and the accumulation value, wherein the parameter adjuster is to:

calculate a primary function between a log value of the current difference ratio and a log value of the accumulation value, the primary function corresponding to the predetermined function, determine first parameter S based on an intercept of the primary function, and determine second parameter T based on a slope of the primary function.

2. The display as claimed in claim 1, wherein the parameter adjuster is to calculate the primary function using a least squares method.

3. The display as claimed in claim 1, wherein first parameter S is a negative number.

4. The display as claimed in claim 1, wherein the pixel is in a display area.

5. The display as claimed in claim 1, wherein the pixel is in a non-display area.

6. A method for driving an organic light emitting display, the method comprising:

measuring current supplied to an organic light emitting diode in a pixel;

adjusting a parameter of a lifetime modeling equation based on the measured current value and an estimated current value corresponding to a pixel value of a current frame; and compensating the pixel value after the current frame based on the lifetime modeling equation and an accumulation value obtained by accumulating pixel values supplied to the pixel until a current frame, wherein the lifetime modeling equation is represented by the following equation:

$$PL = 1 + S \cdot \lambda^{\frac{1}{T}},$$

where PL is indicative of a current emission efficiency prior to degradation of the pixel, S is a first parameter of a predetermined function, T is a second parameter of the predetermined function, and λ is indicative of the accumulation value, wherein adjusting the parameter of the lifetime modeling equation includes:

storing a current difference ratio of the measured current value and the estimated current value corresponding to each frame and the accumulation value during a plurality of frames; and determining the parameter of the lifetime modeling equation based on a relationship between the current difference ratio and the accumulation value, wherein determining the parameter includes:

calculating a primary function between a log value of the current difference ratio and a log value of the accumulation value, the primary function corresponding to the predetermined function; and determining first parameter S based on an intercept of the primary function, and determining second parameter T based on a slope of the primary function.

7. The method as claimed in claim 6, wherein the primary function is calculated using a least squares method.

8. The method as claimed in claim 6, wherein first parameter S is a negative number.

9. A controller, comprising:

an adjuster to adjust at least one parameter of a modeling equation based on a measured current and an estimated current value of a pixel for a current frame, the modeling equation including the at least one adjusted parameter indicative of a real time degree of degradation of the pixel; and a compensator to compensate for image data corresponding to emission of light from the pixel based on the modeling equation including the at least one adjusted parameter, wherein the at least one parameter is a parameter of a primary function between a log value of a current difference ratio and a log value of an accumulation value.

10. The controller as claimed in claim 9, wherein the adjuster is to calculate the primary function using a least squares method.

11. The controller as claimed in claim 9, wherein:

the current difference ratio is a ratio of the measured current and the estimated current value and the accumulation value, and the accumulation value is based on accumulated pixel values supplied to the pixel over a plurality of frames.

12. The controller as claimed in claim 11, wherein the at least one parameter is based on an intercept of the primary function or a slope of the primary function.

13. The controller as claimed in claim 11, wherein the estimated current value is based on a pixel value in first image data.

14. The controller as claimed in claim 9, wherein:

the adjuster is to adjust the at least one parameter of the modeling equation based on the measured current, first image data, and accumulation data, and the compensator is to convert the first image data to second image data based on the adjusted parameter and the accumulation data.

15. The controller as claimed in claim 14, wherein the accumulation data is based on accumulating pixel values in the first image data.

* * * * *